United States Patent [19]

Toho

[11] 3,997,814

[45] Dec. 14, 1976

[54] DISCHARGE LAMP LIGHTING DEVICE

[75] Inventor: Makoto Toho, Kyoto, Japan

[73] Assignee: Matsushita Electric Works, Ltd., Osaka, Japan

[22] Filed: Mar. 21, 1975

[21] Appl. No.: 561,010

[30] Foreign Application Priority Data

Mar. 30, 1974 Japan ..... 49-36460

[52] U.S. Cl. ..... 315/200 R; 315/DIG. 5; 315/DIG. 7; 315/227 R; 315/258

[51] Int. Cl.[2] ..... H05B 37/00

[58] Field of Search ..... 315/DIG. 5, 200 R, 205, 315/DIG. 7, 227 R, 244, 258

[56] References Cited

UNITED STATES PATENTS 3,857,060 12/1974 Chermin ..... 315/DIG. 5 X

*Primary Examiner*—Robert Segal
*Assistant Examiner*—Lawrence J. Dahl
*Attorney, Agent, or Firm*—Leydig, Voit, Osann, Mayer & Holt, Ltd.

[57] ABSTRACT

A discharge lamp lighting device minimized in dimensions and capable of lighting a discharge lamp with a source voltage close to discharge lamp voltage is provided. The device comprises an alternating current source, a discharge lamp connected in series with the alternating current source through a current limiting means and of a lamp voltage substantially equal to the source voltage, and a switching element connected substantially in parallel with the lamp. The switching element is actuated once in each of half cycles of the source voltage so that, when the element is in ON-state, an energy will be accumulated in the current limiting means and, when the element is in OFF-state, such accumulated energy will be exhausted to the discharge lamp, whereby the lamp is continuously lighted.

10 Claims, 13 Drawing Figures

DISCHARGE LAMP LIGHTING DEVICE

This invention relates to discharge lamp lighting devices.

Generally discharge lamps show a negative resistance and therefore require a stabilizer to stabilize their operation by limiting the current. In the case of using a commercial current source, a stabilizing circuit of an inductance element, condenser or a combination of them will be used.

In the case of using such stabilizing circuit, the current source voltage has been required to be of a magnitude about 1.5 to 2.0 times as large as the lamp voltage and it has been impossible to directly light the discharge lamp with a current source voltage close to the lamp voltage. Therefore, as shown in FIG. 1, there has been suggested a lighting circuit wherein a series circuit of an inductance element $L_1$ and condenser $C_1$ is inserted between a current source and a discharge lamp so as to utilize a series resonance of the inductance and condenser. According to this circuit, it is possible to light the discharge lamp of a lamp voltage of about 160 volts with an alternating current of 200 volts. In such case, a separate starter ST will be used for starting. In such conventional device, however, it has been impossible to light the discharge lamp without using a booster transformer directly from the current source by bringing the current source voltage and lamp voltage closer to each other than the above exemplified values and, therefore, a fluorescent lamp of, for example, 40W with a lamp voltage of about 105V has never been able to be lighted with an A.C. of 100V.

The present invention has been suggested to improve such conventional defect as above and has successfully solved the problem by accumulating an electric energy in a current limiting element connected with an alternating current source and exhausting such accumulated electric energy to a discharge lamp in addition to a source voltage, so that the voltage applied to the discharge lamp will be boosted to be higher than the source voltage and whereby the discharge lamp will be lighted by a current source voltage close to or lower than the discharge lamp voltage.

A main object of the present invention is, therefore, to provide a discharge lamp lighting device which can light a discharge lamp even with a current source voltage close to the discharge lamp voltage.

Another object of the present invention is to provide a discharge lamp lighting device wherein any difference between the current source voltage and the discharge lamp voltage can be made small and the current limiting element can be made small.

A further object of the present invention is to provide a discharge lamp lighting device which can continuously light a discharge lamp even when a stabilizer of a simple formation is used.

The present invention shall be explained in the following with reference to certain preferred embodiments as shown in accompanying drawings, in which.

Figure 8:
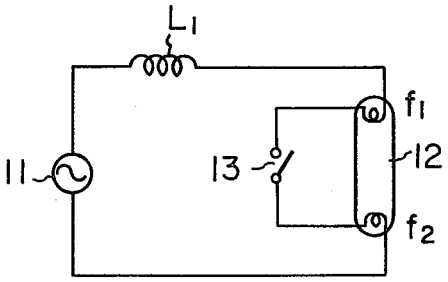
Figure 9A:
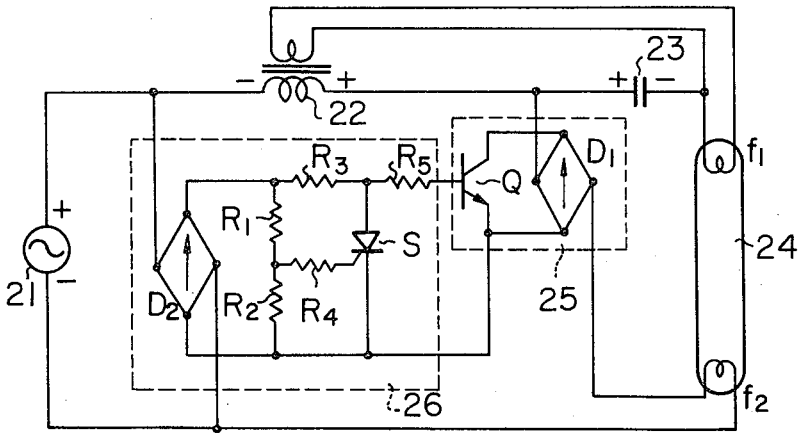
Figure 9B:
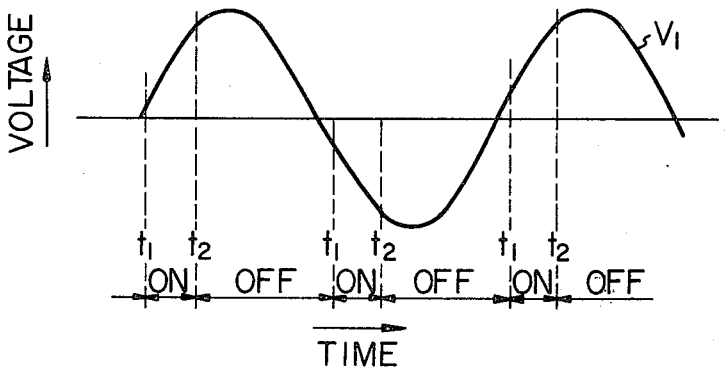
Figure 10A:
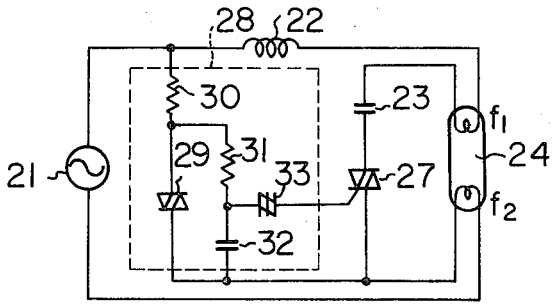
Figure 10B:
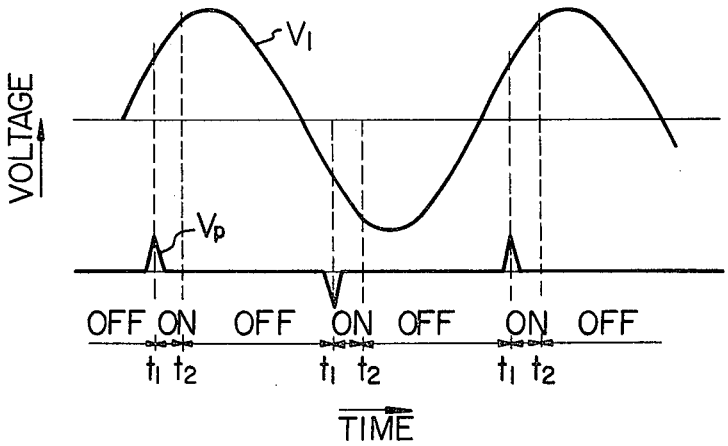

FIGS. 9A and 9B respectively show a practical circuitry arrangement of the embodiment shown in FIG. 8 and its operation explanatory diagram; and FIGS. 10A and 10B respectively show a further practical circuitry arrangement and its operation explanatory diagram.

Figure 1:
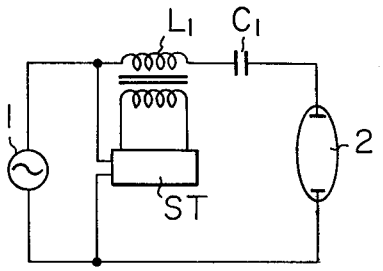
Fig. 1 (PRIOR ART)
FIG. 1 shows a circuit of a conventional discharge lamp lighting device.
Figure 2:
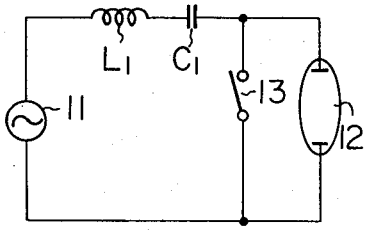
FIG. 2 is a circuit of an embodiment of discharge lamp lighting device according to the present invention.

Referring now to a first embodiment shown in FIG. 2 of the present invention, an inductance element $L_1$, condenser $C_1$ and discharge lamp 12 are connected in series with an alternating current source 11 and a switching element 13 is connected in parallel with said discharge lamp 12. The ON-OFF mode of the switching element 13 is such that, as shown as a hatched section in FIGS. 3A or 3B, it will be ON in the latter half period of a half cycle of the alternating current source 11 and will be OFF at the end of the half cycle as in FIG. 3A, or will be ON for a fixed period from a fixed phase in the latter half of the half cycle to a moment before or after the end period of this half cycle begins as in FIG. 3B.

While the switching element 13 is ON, an electric charge will be accumulated in the condenser $C_1$ and, in the next half cycle, the voltage across the condenser $C_1$ due to the electric charge accumulated in this condenser will be superimposed on the voltage of the commercial current source 11 and will be impressed on the discharge lamp 12. That is to say, the circuit of this embodiment is formed of a first circuit comprising the series circuit of the inductance element $L_1$ and condenser $C_1$ and the discharge lamp 12 and a second circuit for energy accumulation comprising the switching element 13, inductance element $L_1$ and condenser $C_1$.

Figure 3A:
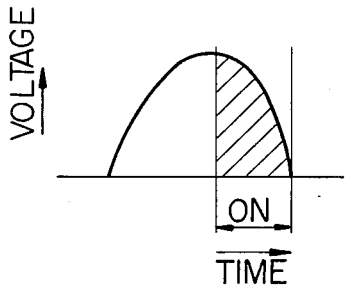
FIGS. 3A and 3B are diagrams respectively for explaining ON-period of switching element employed in the embodiment of FIG. 2.
Figure 3B:
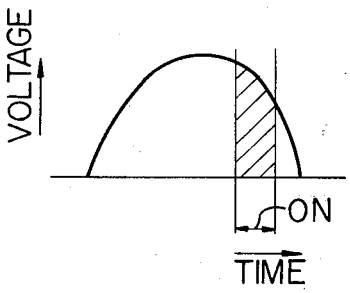
Figure 4:
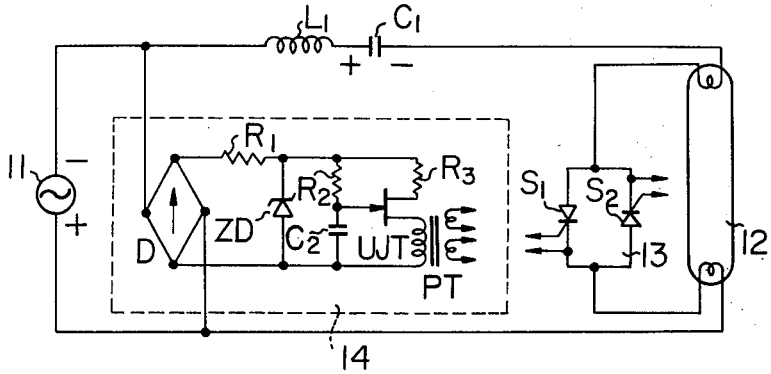
FIG. 4 shows a practical circuitry arrangement of the embodiment shown in FIG. 2 of the present invention.
Figure 5:
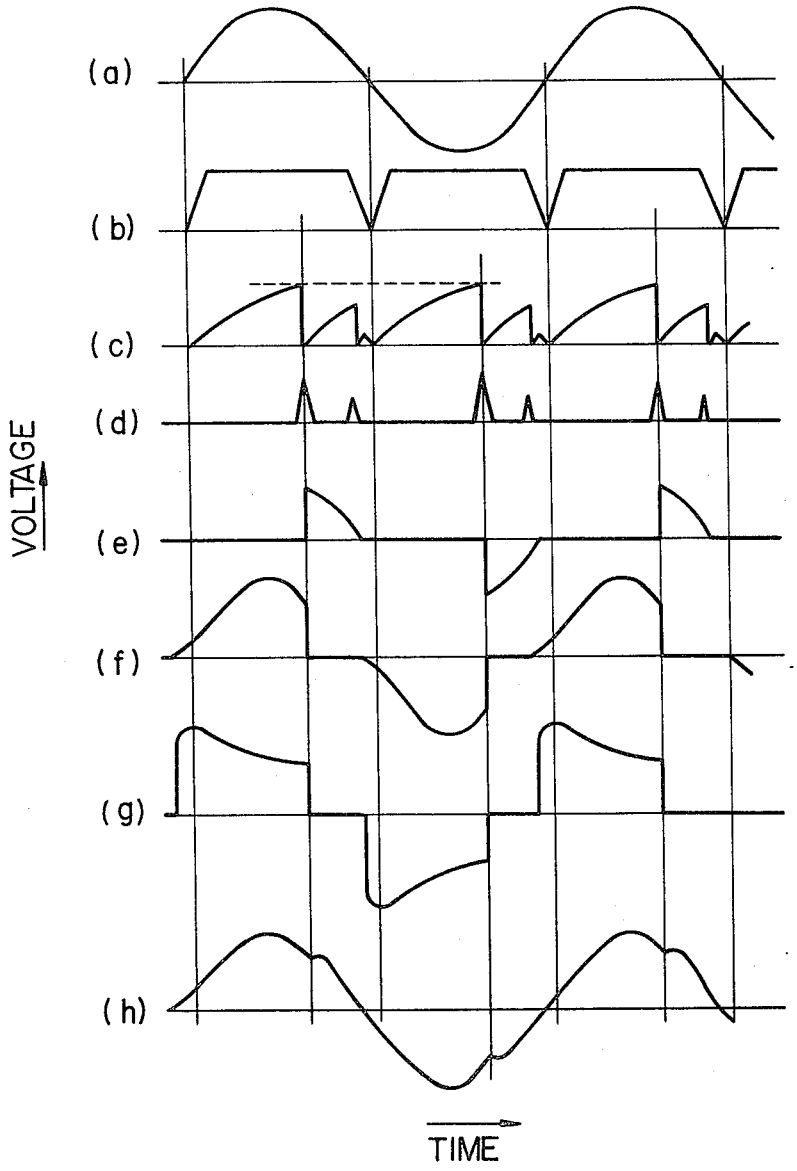
FIG. 5 is a set of wave form diagrams for explaining voltages at respective parts in the circuit of FIG. 4.

FIG. 4 shows an exemplary practical circuit arrangement of the embodiment in FIG. 2, and FIG. 5 shows voltage wave forms at respective parts in the circuit of FIG. 4. In this circuit, the ON-OFF mode as shown in FIG. 3A is used for the switching element 13. Now, when such current source voltage as is shown by a wave form (*a*) in FIG. 5 is applied to this circuit by the alternating current source 11, a voltage will be provided to a constant voltage diode ZD of a control circuit 14 through a resistance $R_1$ from a rectifying bridge D. This voltage will be converted to such a trapezoidal rectified voltage as shown by a wave form (*b*) in FIG. 5 being substantially free of influence caused by fluctuations in the current source voltage. Since a series circuit including a resistance $R_2$ and condenser $C_2$ is connected across the constant voltage diode ZD, this condenser $C_2$ will be charged with such a voltage as shown by a wave form (*c*) in FIG. 5. On the other hand, when the voltage across the condenser $C_2$ reaches a peak point voltage $V_p$ of a unijunction transistor (which shall be abbreviated as UJT hereinafter) connected to the series circuit, the electric charge of the condenser $C_2$ will be discharged through this UJT and a pulse transformer PT and such pulse voltages as shown by a wave form (*d*) in FIG. 5 will be generated at output windings of the pulse transformer PT, which voltages will be impressed respectively between the gate and the cathode of two thyristors $S_1$ and $S_2$ forming the switching element 13. With these pulses generated by the pulse transformer PT, one of the two thyristors $S_1$ and $S_2$ to which a positive voltage is applied will conduct, so that the thyristor $S_1$ or $S_2$ forming the switching element will conduct in the latter period of the half cycle of the alternating current source 11 and thus the ON-OFF mode of the switching element as in FIG. 3A will be attained. Therefore, such a current having a wave form (*e*) in FIG. 5 will flow through the inductance element $L_1$ and condenser $C_1$ from the alternating current source 11, the series resonance circuit of the inductance element $L_1$ and condenser $C_1$ will resonate and the electric charge will be accumulated in the condenser $C_1$ with such polarity as shown in FIG. 4. These thyristors $S_1$ and $S_2$ will be OFF when the current from the commercial A.C. source 11 tends to reverse and, therefore, the electric charge will last without being discharged until the next half cycle of the source current. Then, if the alternating current from the source 11 reverses to be in the polarity illustrated in FIG. 4, an additional high voltage of the voltage of the alternating current from the source 11 and the voltage across the condenser $C_1$ will be applied to the discharge lamp 12 during the next half cycle, since the polarity of the accumulated charge in the condenser $C_1$ is as shown in FIG. 4 as referred to in the above. Thus, such high voltage is being applied to the discharge lamp 12 for re-igniting the same and maintaining its lighting and, therefore, the discharge lamp 12 will be immediately re-ignited and will keep on lighting so that such lamp current as is shown by a wave form (*f*) in FIG. 5 will be caused to flow. The lamp voltage in such case will be as shown by (*g*) in FIG. 5. Then, a certain position in the half cycle of this alternating source current is reached, the thyristor $S_1$ or $S_2$ will be ON and the switching element 13 will be again conducted, so that the same operation as has been described above will be repeated, whereby the input voltage wave form of the entire circuit will be continuous as shown by a wave form (*h*) in FIG. 5.

Figure 6:
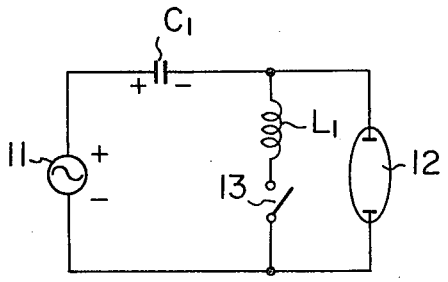
FIGS. 6 to 8 show respectively another embodiments of the present invention.

Now, FIG. 6 shows another embodiment of the present invention, wherein the condenser $C_1$ and discharge lamp 12 are connected in series with the alternating current source 11 and a series circuit of the inductance $L_1$ and switching element 13 is connected in parallel with said discharge lamp 12.

The operation of this embodiment is as follows: (i) When the switching element 13 is switched ON at a certain phase $t_1$ in the half cycle of the alternating current from the source 11, the inductance $L_1$ and condenser $C_1$ will cause a series resonance to occur and, when the alternating source current is of the illustrated polarity, an electric charge of the illustrated polarity will be accumulated in the condenser $C_1$. (ii) Next, the point at which the current flowing through the switching element 13 becomes zero is so selected as to enter the next half cycle of the source current and to have the switching element 13 switched to be OFF at this point. (iii) As an electric charge of the maximum level is accumulated in the condenser $C_1$ with the illustrated polarity upon switching OFF of the switching element 13 and the polarity of the alternating current from the source 11 is reverse to the illustrated one, the voltage across the condenser $C_1$ will be added to the source current voltage and will be applied to the discharge lamp 12. (iv) Therefore, the discharge lamp 12 will be easily re-ignited and, during the half cycle, the energy accumulated in the condenser $C_1$ will be added to the alternating source current voltage and will be transmitted to the discharge lamp 12.

Figure 7:
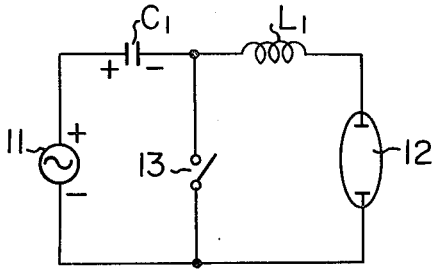

In another embodiment of the present invention shown in FIG. 7, the embodiment $C_1$, inductance $L_1$ and discharge lamp 12 are connected in series with the alternating current source 11 and the switching element 13 is connected with a series circuit of the inductance $L_1$ and discharge lamp 12 in parallel relation to the source 11 and lamp 12.

The operation of this embodiment is as follows: (i) When the switching element 13 is switched ON at a certain phase $t_1$ in the half cycle of the current from the source 11, an electric charge of a momentary voltage part of the source current will be accumulated in the condenser $C_1$ and the switching element 13 will be switched OFF. When the source current voltage is of the illustrated polarity, an electric charge of the illustrated polarity will be accumulated in the condenser $C_1$. (ii) When the source current is in the next half cycle, the voltage across the condenser $C_1$ will be added to the source current voltage and will be transmitted to the discharge lamp 12 so that the lamp 12 will be easily re-ignited. (iii) In this half cycle, the energy accumulated in the condenser $C_1$ will be added to the voltage of the alternating current from the source 11 and will be exhausted to the discharge lamp 12 but, because the current will be series resonant with the condenser $C_1$ and inductance element $L_1$, the wave form of this current will be of a sine wave.

Referring to a further embodiment of the present invention as shown in FIG. 8, a series closed circuit of the current source 11, the inductance element $L_1$, a filament $f_1$ of the discharge lamp 12, the switching element 13 and a filament $f_2$ is formed.

The operation of this embodiment in FIG. 8 is as follows: (i) From the beginning of the half cycle of the current source voltage to a certain phase $t_1$ thereof, the switching element 13 will be ON. (ii) Meanwhile, a current will be provisionally caused to flow to the filaments $f_1$ and $f_2$ of the discharge lamp 12 through the inductance element $L_1$ and switching element 13 from the alternating current source 11 so as to heat the filaments and an energy will be accumulated in the inductance element $L_1$. (iii) At the phase $t_1$, the switching element 13 will be OFF and a kick voltage $L(di/dt)$ will be generated in the inductance element $L_1$, which voltage will be added to the voltage of the alternating current from the source 11 so as to help the heating of the filaments, so that the discharge lamp will be easily re-ignited. (iv) Then, during the remainder of the half cycle, the energy in the inductance element $L_1$ will be added to the source current voltage and will be transmitted to the discharge lamp.

In a practical circuit arrangement of the embodiment shown in FIG. 8 of the present invention, an alternating current source 21 is connected with an inductance element 22, condenser 23, filament $f_1$ of a discharge lamp 24, rectifying bridge $D_1$ and filament $f_2$, and a switching element 25 is formed of the rectifying bridge $D_1$ and a transistor Q and is controlled by a controlling device 26. Further, the filaments $f_1$ and $f_2$ of the discharge lamp 24 are so arranged as to be heated by the current flowing through the secondary side winding of the inductance element 22. The controlling device 26 is formed in such that a rectifying bridge $D_2$ is connected at plus side output end with the base of the transistor Q in the switching element 25 through resistances $R_3$ and $R_5$ and at minus side output end with the emitter of the transistor Q, a series circuit of resistances $R_1$ and $R_2$ is connected across the both output ends of the rectifying bridge $D_2$, and a thyristor S is inserted between connecting point of the resistances $R_3$ and $R_5$ and an intermediate between the minus side output end of the rectifying bridge $D_2$ and the emitter of the transistor Q while the gate is connected through a resistance $R_4$ to connecting point of the resistances $R_1$ and $R_2$. The collector of the transistor Q in the switching element 25 is connected to plus side output end of the rectifying bridge $D_1$ and its emitter is connected further to minus side output end of the bridge $D_1$.

The operation of this controlling device 26 in the above circuit is as follows. A full wave rectifying current appearing at the output end of the rectifying bridge $D_2$ will be provided to the base of the transistor Q through the resistances $R_3$ and $R_5$ and the switching element 25 will be ON at the phase $t_1$ (see FIG. 9B) of the source current voltage. On the other hand, the above rectifying voltage will be provided also to the resistances $R_1$ and $R_2$. At a phase $t_2$ (FIG. 9B) determined by the resistances $R_1$, $R_2$ and $R_4$ and the gate sensitivity of the auxiliary thyristor S, a gate current sufficient for igniting the thyristor S will be provided and the thyristor S will conduct. When the thyristor S is ON, the base and emitter of the transistor Q will be short-circuited and therefore the switching element 25 will be OFF from the phase $t_2$ to the end of the half cycle of the source current voltage.

The operation of the entire discharge lamp lighting device of FIG. 9A shall be explained now. When the discharge lamp 24 is kept in its lighted state by means of a starting device (not illustrated), the switching element 25 is switched ON at a fixed phase $t_1$ near the beginning of each half cycle of the source current voltage as shown in FIG. 9B, as described before. Then, a current will flow through the inductance element 22 from the alternating current source 21 and an energy of the illustrated polarity will be accumulated in this inductance element 22. Further, when the switching element 25 is switched OFF at a phase $t_2$, a high voltage will be transiently generated in the inductance element 22 by its accumulated energy. This voltage across the inductance element 22 will be caused to be applied to the discharge lamp 24 so that a lamp current comprising the electric power from the alternating current source 21 and the accumulated energy of the inductance element added to the source power will be fed to the discharge lamp 24. The switching element 25 will switch ON again at the next phase $t_1$ when the source current voltage enters its next half cycle and the feed of the lamp current from the alternating current source 21 to the discharge lamp will stop. However, during the period from the phase $t_2$ to the next phase $t_1$, the auxiliary condenser 23 is being charged in the illustrated polarity with the lamp current and, at the same time when the switching element 25 is closed at the next phase $t_1$, the accumulated charge in the auxiliary condenser 23 will be exhausted through the switching element 25 in its closed state and the discharge lamp 24, so that a lamp current will flow in the same direction as that of the source current voltage. Therefore, even when the lamp current by means of the alternating current source 21 and the accumulated energy of the inductance element 22 stops, the lamp current will be kept flowing due to the auxiliary condenser 23.

Referring next to FIG. 10A showing another practical circuit arrangement of the embodiment of FIG. 8 according to the present invention, the alternating current source 21 forms in the present instance a closed circuit together with the inductance element 22, the filament $f_1$ of the discharge lamp 24, condenser 23, a triac 27 used as the switching element and the filament $f_2$ of the lamp 24. 28 is a controlling circuit for the triac 27. For this controlling circuit 28, a relaxation oscillation circuit is used in the present instance, which comprises a constant voltage element 29 for the alternating source current and connected at one end with the alternating current source 21 and at the with the filament $f_2$ of the discharge lamp 24, a series circuit of a resistance 31 and a condenser 32 connected across said constant voltage element 29, and a bidirectional switching element 33 inserted between the connecting point of said resistance 31 and condenser 32 and the gate of the triac 29.

The operation of this circuit shall be explained in the following. In case the discharge lamp 24 has completed the starting lighting and keeps lighted, a pulse voltage will be generated by the controlling circuit 28 at the constant phase $t_1$ of each half cycle of the source current voltage $V_1$ as shown in FIG. 10B, and this pulse voltage will be provided to the gate of the triac 27 to switch the same ON. When the triac 27 is switched ON, a current steeply rising will be caused to flow to the triac 27 through the inductance element 22, due to an oscillating action of the inductance element 22 and condenser 23. With this current, an electric energy will be accumulated in the inductance element 22. On the other hand, an electric charge will be also accumulated in the condenser 23. The voltage across this condenser 23 is being applied to the discharge lamp 24 through the triac 27 and, when the increase of this voltage reaches a certain value, the discharge lamp 24 will quickly tend to show a negative resistance characteristic and the charged electric charge of the condenser 23 will be discharged through the discharge lamp. When the electric charge of the condenser 23 is discharged, an electric current will flow in the direction reverse to that of charging the condenser, and the triac 27 will be switched OFF at the phase $t_2$ of the source current voltage. When the triac is switched OFF, a large voltage will be transiently generated by the accumulated energy of the inductance 22, which will be added to the source current voltage $V_1$ and will be applied together to the discharge lamp. The discharge lamp will be immediately re-ignited by the high voltage thus applied and will be fed with a lamp current by the alternating source current and the electric power energy accumulated by the inductance element 22.

When the triac 27 is switched ON at the phase $t_1$ in the next half cycle of the source current voltage $V_1$, the condenser 23 is caused to be again in parallel relation to the discharge lamp 24, so that the electric power energy will be accumulated again in the inductance element and the same operation will be repeated.

What is claimed is:

1. A discharge lamp lighting device for use with an alternating current source comprising in combination, a discharge lamp having a lamp operating voltage substantially equal to the voltage of said alternating current source, a current limiting element interposed between said alternating current source and said discharge lamp, means including a switching element shunting said discharge lamp, closing of said switching element serving to energize a first circuit for accumulating energy from said alternating current source in said current limiting element, opening of said switching element serving to energize a second circuit for exhausting the accumulated energy from the current limiting element to said discharge lamp, and control means for opening and closing said switching element once during each half cycle of the alternating current source thereby to add the voltage across said current limiting element to the voltage of said alternating current source for producing a voltage in excess of the lamp operating voltage to light said lamp and maintain the lighted condition thereof.

2. The device as defined in claim 1 wherein said current limiting element comprises a series circuit including an inductance and a condenser interposed between said discharge lamp and said alternating current source, said switching element being connected between said series circuit and the discharge lamp in parallel with the lamp.

3. The device as defined in claim 1 wherein said current limiting element comprises a condenser, said means shunting said discharge lamp including an inductance connected in series with said switching element.

4. The device as defined in claim 1 wherein said current limiting element comprises a series circuit including a condenser coupled to said alternating current source and an inductance coupled to said discharge lamp, said condenser and inductance forming a junction therebetween, said switching element being connected from said junction across said discharge lamp.

5. The device as defined in claim 1 wherein said current limiting element comprises an inductance element, said discharge lamp having first and second filaments, said switching element being connected between said first and second filaments of said discharge lamp so that closing of said switching element completes a closed circuit including said alternating current source, inductance element, first filament of the discharge lamp, switching element and second filament of the discharge lamp.

6. The device as defined in claim 1 wherein said switching element comprises a pair of symmetrical thyristors connected in reverse parallel with each other, said control means including means synchronized with current from said alternating current source for producing trigger signals at a fixed phase in each half cycle of said source current, and means coupling said trigger signals to said thyristors for alternately firing same.

7. The device as defined in claim 2 wherein said switching element comprises a pair of thyristors connected in reverse parallel with each other, said control means comprising means for rectifying the voltage of said alternating current source, an oscillator coupled across said rectifying means for producing trigger signals at a predetermined phase in each half cycle of said alternating source current, and means coupling said trigger signals to said thyristors for alternately firing same.

8. The device as defined in claim 5 further including a condenser connected in series between said inductance and said first filament, said condenser and inductance forming a junction therebetween, said switching element comprising a first rectifying bridge connected between said junction and said second filament of the discharge lamp, and a transistor having a collector emitter circuit coupled across the output terminals of said first rectifying bridge, a second rectifying bridge connected across said alternating current source, means coupling said second rectifying bridge to the base emitter circuit of said transistor, a thyristor connected across the base emitter circuit of said transistor, and a series circuit including two resistors connected across the output terminals of said second rectifying bridge, the junction between said two resistors being coupled to the gate of said thyristor.

9. The device as defined in claim 5 wherein said switching element comprises a triac, said means shunting said discharge lamp forming a series circuit including a condenser connected between said first filament of the discharge lamp and said triac, and a relaxation oscillator circuit coupled to said alternating current source for triggering said triac.

10. The device as defined in claim 9 wherein said relaxation oscillator circuit comprises a constant voltage element and a resistance serially coupled between said alternating current source and said second filament of the discharge lamp, a series circuit including a second resistance and a second condenser connected across said constant voltage element, and a symmetrical switching element connected from the junction between said second resistance and second condenser to the gate of the triac.

* * * * *